US006042066A

United States Patent [19]

Maharg et al.

[11] Patent Number: 6,042,066

[45] Date of Patent: Mar. 28, 2000

[54] FLOOR TO CEILING TENSION SUPPORT POLE WITH LOCKING MECHANISM

[75] Inventors: James C. Maharg, Ridgefield, Conn.; Zenda Snyder, New York City, N.Y.

[73] Assignee: Look, Inc., New York, N.Y.

[21] Appl. No.: 09/047,597

[22] Filed: Mar. 25, 1998

[51] Int. Cl.[7] ..... E04G 25/00

[52] U.S. Cl. ..... 248/200.1; 248/351; 248/354.1; 52/127.2

[58] Field of Search ..... 248/351, 354.1, 248/200.1; 52/127.2, 126.5, 126.6, 111

[56] References Cited

U.S. PATENT DOCUMENTS

| | | | |
|---|---|---|---|
| 1,809,401 | 6/1931 | Cattell | 248/200.1 |
| 2,974,931 | 3/1961 | Reel et al. | 248/354.1 |
| 3,161,264 | 12/1964 | Isaacson | 248/351 |
| 3,228,646 | 1/1966 | Hinrichs et al. | 248/351 |
| 4,576,354 | 3/1986 | Blessing, Sr. | 248/351 |
| 5,186,429 | 2/1993 | Linnepe et al. | 248/354.1 |

*Primary Examiner*—Timothy V. Eley
*Assistant Examiner*—Willie Berry, Jr.
*Attorney, Agent, or Firm*—Levisohn, Lerner, Berger and Langsam

[57] ABSTRACT

A tension pole comprising an outer, lower pole piece and an inner, upper pole piece. The bottom of the lower pole piece and the top of the upper pole piece are provided with rubber feet. The pole pieces are telescopable to adjust the length of the tension pole. A locking mechanism is provided which further telescopes one piece relative to the other to lock the tension pole between floor and ceiling with the rubber feet absorbing at least a part of the telescopic movement due to the locking action. Locking is done by turning a handle. Also, the locking/telescoping action simultaneously frictionally engages the pole pieces together to further secure the device.

36 Claims, 10 Drawing Sheets

FLOOR TO CEILING TENSION SUPPORT POLE WITH LOCKING MECHANISM

BACKGROUND OF THE INVENTION

The present invention relates to support poles mounted floor to ceiling and secured therebetween by tension. These tension poles, as they have been called, are held between a floor and ceiling and have a variety of uses, including but not limited to, providing a means for support, often for temporary purposes, for horizontal poles at trade shows and exhibitions, lighting fixtures in homes or offices, and for display purposes in department or retail stores. The present invention relates to a new tension pole which quickly, easily and securely is erected and firmly supported between floor and ceiling.

DESCRIPTION OF THE PRIOR ART

Tension poles currently exist and provide a mechanism for supporting other mechanisms or devices, for example, spot lighting fixtures, horizontal poles for garment displays, shelves, etc. The tension poles are effective as a temporary or even permanent means of support and can be erected and secured in a minimum of time with little mechanical ability. Tension poles are versatile because they can be located nearly anywhere, extend vertically, and span the distance between floor and ceiling. The tension of the device, between floor and ceiling, provides the stability to maintain the pole in position.

The tension poles of which we are familiar are generally comprised of a single pole having on its bottom a rubber foot to contact and grip the floor. At the other end of the pole from the foot, a smaller diameter pole is telescopically housed in the pole. It is a spring-biased, smaller diameter rod, having on its upper end a rubber foot, intended to contact the ceiling.

In operation, the rubber foot on the floor side of the device is placed on the floor where the pole is desired to be erected. Then, the user pushes on the rod, against the force of the spring, to temporarily collapse and telescope the rod into the pole. Then, with the rod so held (recessed into the pole) the pole is tilted into as near to a vertical orientation as possible. Then, the rod is manually released such that the internal spring of the device (biasing the rod outwardly) causes the upper, rubber foot to contact the ceiling. Hopefully, the pole is truly vertical and the operation is complete. If the pole is askew to the vertical, then the user can, again, push the rod into the pole, against the outward bias of the spring, in an effort to align the pole into a vertical orientation.

The installation is not always easy since the user is trying to compress a rod into the pole, against the strong outward bias of the spring, and, at the same time, is trying to place the pole into a vertical orientation before releasing the rod, so that when the rod is released, the force of the spring causes the rod (with its ceiling-contacting rubber foot) to telescope outwardly until the rubber foot contacts the ceiling. It should be readily apparent that the tension pole of the prior art, of the telescopic pole, rod and spring type, is sometimes difficult to operate. Also, its strength of being held in a vertical position is directly dependent on the strength of the contained spring. Yet, the stronger the spring, which will hold the pole in place, the more difficult the installation since to perform the installation the spring is first manually compressed until selectively released.

Also, the tension pole of the prior art is difficult to install by relatively short people since the collapsible rod portion is usually located at or near the top of the pole. The pole is generally of uniform cross section for its length and the telescopic rod, with its ceiling-contacting rubber foot, is at the pole's top, often taking up only about one foot of the overall height of the device. Since the tension pole is often erected between floor and ceiling (which spans about 8 feet) this means that the rod to be compressed is usually about 7 feet from the floor. For shorter people then, it is difficult to compress the rod, at the 7 foot level, and simultaneously tilt the pole into a vertical orientation. It is not easily done.

Carpenters can easily erect beams which extend between floor and ceiling and can then be used to support other devices. The beams are generally constructed at the sidewalls of the room. It is, however, often desirable to have the support mechanisms in the middle of the room, temporarily located so as to be easily removed, when desired, without damage to the room, and, in any event, it is desirable not to have to employ a carpenter each time that such a support pole is desirably erected. Also, obviously, there is a great need for a support pole which can be easily and quickly installed, without harming the floor and ceiling, wherein the installation is secure and, yet, the operations of installation and subsequent removal are easily performed by a layman.

SUMMARY OF THE INVENTION

It is an object of the current invention to provide a tension pole with a locking mechanism which will more securely attach between the floor and ceiling by an easily operated, mechanical mechanism.

It is a further object of the current invention to provide a tension pole with a locking mechanism which is easily and expeditiously locked and unlocked, as needed by the user.

It is another object of the present invention to provide a tension pole where the locking and unlocking mechanism is operable at a location along the length of the pole such that those of average or even below average height, in addition to those being tall, can easily erect and secure the same between floor and ceiling.

It is an object of the present invention to provide a tension pole with a locking and unlocking mechanism which more securely holds the pole between ceiling and floor than the prior art devices. It is an object of the present invention to provide a tension pole with a securing mechanism which is simple to operate and basically requires a single motion by the user to lock and hold the same in position and a single reverse motion to disassemble the same.

It is also an object of the present invention to have the strength of the mechanism holding the pole in place greater than that provided by a mechanical spring housed within the pole and, further, for the strength of the mechanism holding the pole between ceiling and floor not serve as a hindrance in the erection and location of the pole, as appears with the spring type tension poles of the prior art.

It is a further object of the present invention to provide a tension pole which has a locking and unlocking mechanism which operates by a simple turning of a handle. It is also an object of the invention to provide a locking and unlocking mechanism with a visual indicator for quickly indicating to the user that the pole is either locked in position or is unlocked.

It is a further object of the present invention to provide a locking and unlocking mechanism for a tension pole which provides an effective holding mechanism between floor and ceiling by frictional engagement between two telescopic parts forming the pole.

It is an object of the present invention to provide a simple tension pole for support, capable of being located within a room, spanning the floor and ceiling. It is an object of the present invention to provide such a tension pole which can be quickly and easily erected and removed, as desired, without damage to the floor or ceiling and, yet, when in place is securely and precisely located.

The objects of the present invention are accomplished by providing two telescopic tension pole pieces or tubes, namely, an inner, upper tension pole piece and an outer, lower tension pole piece. The two pieces, preferably square or rectangular in cross-section, telescope (the upper piece slides within the lower piece) to accommodate the distance between floor and ceiling and slight differences in the 8' dimension between most floors and ceilings. A locking mechanism for securing the two poles relative to one another and firmly between floor and ceiling is provided. In the preferred embodiment of the present invention, the locking mechanism is a set of mechanical components which cooperate for the desired function. To the end user, however, the locking/unlocking mechanism simply comprises a handle for rotation, which handle is located at or about the top of the outer, lower pole piece. It will be readily appreciated that a tension pole with a locking mechanism which facilitates the easy and expeditious telescoping and locking and unlocking of the pole is desirable for its convenience, security and practicality.

According to the invention, the inner, upper tension pole piece telescopes within the outer, lower tension pole piece. With the rubber foot of the outer, lower pole piece placed onto the floor position where the tension pole is to be located, the user manually extends and telescopes the inner, upper pole to the desired height. The inner, upper pole piece is extended until its rubber foot contacts the ceiling. As mentioned, this is done while the rubber foot of the outer, lower pole piece is in contact with the floor at the desired location. The rubber foot of the upper pole piece is then, hopefully, directly above the location of the rubber foot of the outer, lower pole piece. A bubble level can be used to ensure vertical alignment. This is the desired location of the tension pole. It is here that the tension pole is desirably locked into position. When the desired overall height of the tension pole is reached by the manual telescopic action between floor and ceiling and the user confirms the proper location of the rubber feet, the user then rotates or cranks the handle 180 degrees from a vertically directed "up" (unlocked) position to a vertically directed "down" (locked) position. The handle is mechanically linked to the inner, upper pole piece and outer, lower pole piece such that rotation of the handle pulls the inner pole toward the outer pole to frictionally secure the pole pieces and, yet, simultaneously further extends the inner pole approximately ½ inch to more securely locate the rubber feet of the pole pieces between the floor and ceiling. The turning of the handle telescopes or extends the inner, upper pole piece a further ½" to firmly secure the tension pole in place where the rubber feet contact the floor and ceiling (which ½ inch can be entirely absorbed, if necessary, by the resiliency or compressibility of the rubber feet). The locking mechanism serves to frictionally pull the inner, upper pole piece toward the outer, lower pole piece to frictionally lock the two components together.

These and other aspects of the present invention will be more easily understood when the following description of the invention is considered with reference to the drawings.

DETAILED DESCRIPTION OF THE DRAWINGS AND THE PREFERRED EMBODIMENT OF THE INVENTION

Figure 1:
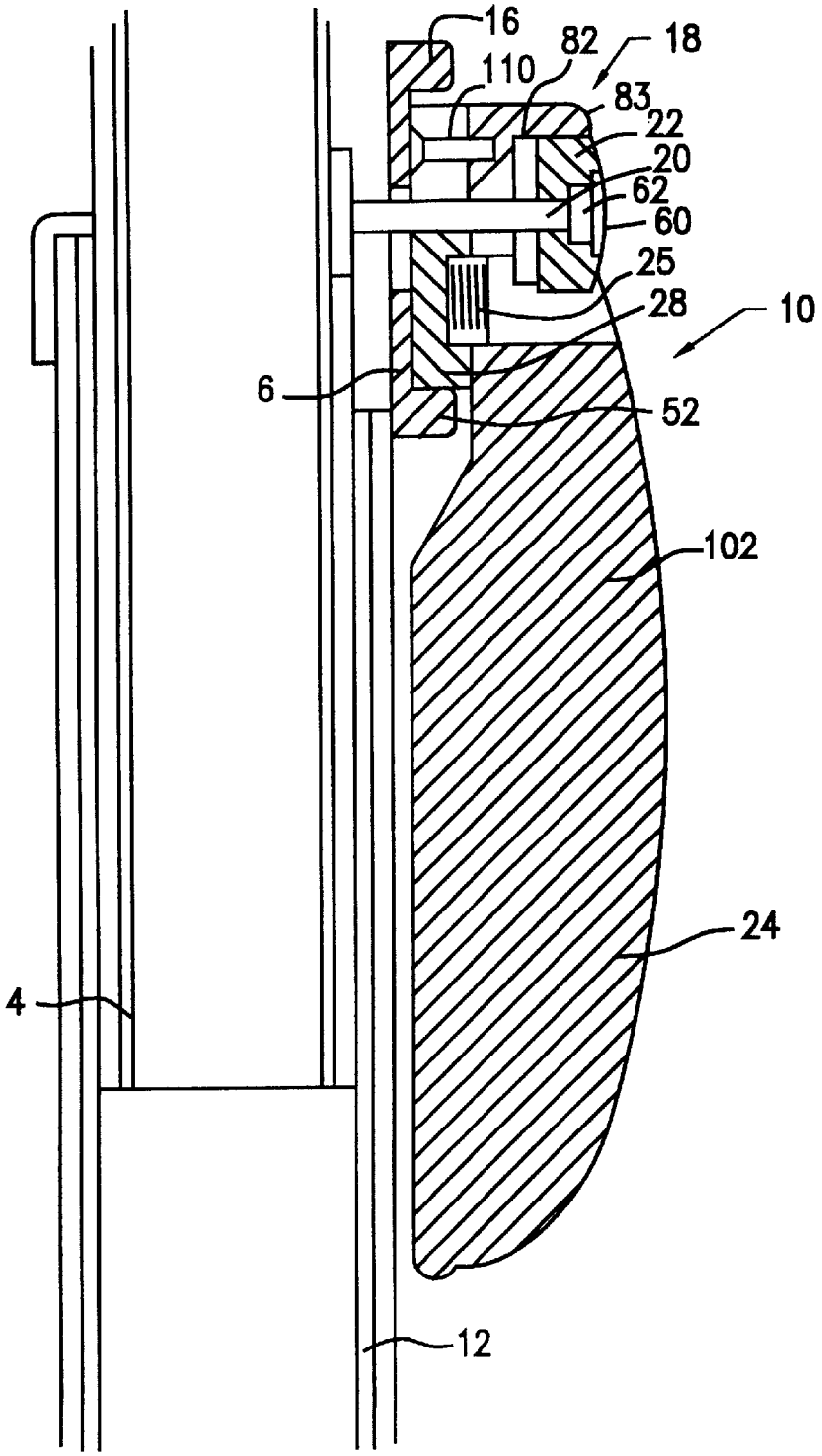
FIG. 1 is a partial, cross-sectional view of an embodiment of the present invention showing a portion of the inner, upper pole piece; the outer, lower pole piece; and the locking mechanism with handle in the locked position.
Figure 2:
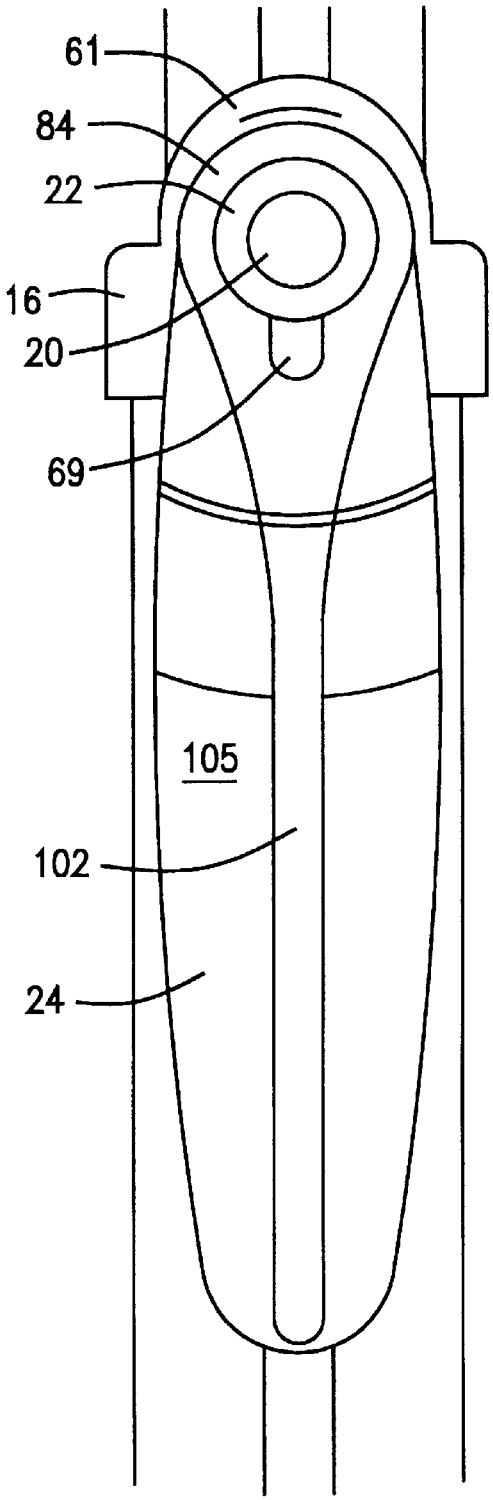
FIG. 2 is a partial, front, plan view of FIG. 1 also showing the invention.

As seen in FIG. 1, the floor to ceiling tension support pole with locking mechanism 10 basically comprises two tension pole pieces 12 and 14. A locking mechanism 18 is provided to ensure that the requisite tension is provided to lock the pole pieces between floor and ceiling and to one another. Pole piece 12 is the outer, lower pole while inner, upper pole 14 is located within and above pole piece 12. The pole pieces 12 and 14 are basically square or rectangular in cross-section and tubular yet provided on one or more faces with dovetail shaped channels running along their length. The advantages of a square-sectioned pole piece are several in nature. A square tension pole according to the invention is more aesthetically pleasing and structurally sound than a round tension pole. A horizontal support platform can be easily fitted between two square tension poles without leaving a gap; the straight edge of a typical support platform would leave a gap when abutting a tension pole having a circular cross-section. The pole pieces 12 and 14 are preferably made from extruded aluminum although other materials may, of course, be used as is understood by those of ordinary skill in the art. Aluminum is the preferred material of choice because it is relatively lightweight and, yet, provides structural strength and rigidity. Also, aluminum can be easily formed by metal working and/or extrusion processing.

A cam receiver 16 is provided on the outer surface of the outer, lower pole piece 12 and together with the other mechanical components, cam, plug, dovetail nut, etc. (to be further described) and handle make up a locking mechanism 18. The locking mechanism 18 is located at the junction of the inner, upper pole piece 14 and the outer, lower pole piece 12. The cam receiver 16 is preferably formed from molded cast aluminum although high strength plastic or other suitable materials can be used, too. The cam receiver 16 fits on top of the upper edge of the outer, lower pole piece 12 and provides an overhang and a ledge for the cam (See FIG. 3). The cam receiver is rectangularly hollow and provided with an inside ridge 110 (see FIG. 7) which allows it to fit over the outer, lower pole piece 14. Ridge 110 will locate the cam receiver so that it will remain on the top edge of the outer, lower pole piece, i.e., it cannot slide downwardly along the length of the outer, lower pole piece.

The handle is also preferably molded or formed from aluminum and can be coated with rubber or plastic for texture/aesthetics or, it, too, can be molded from strong plastic. It, too, can be formed of other materials depending upon the desired look of the handle, weight, economy of manufacture, etc.

Figure 8:
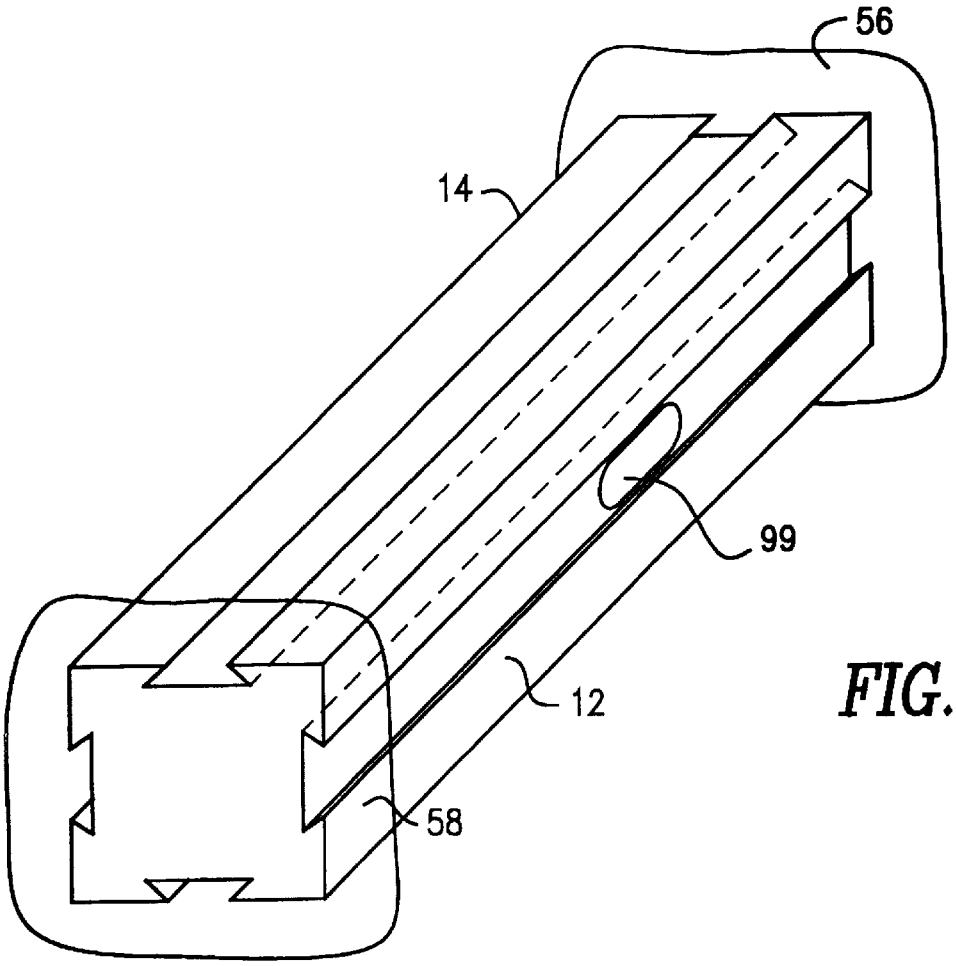
FIG. 8 is a perspective view of the tension pole pieces, inner, upper pole piece and outer, lower pole piece, along with their respective rubber feet but shown without the cam receiver nor the locking mechanism.

The outer, lower pole piece 12 has a rubber foot 58 (see FIG. 8) and the inner, upper pole piece 14 has a rubber foot 56. The two pole pieces 12 and 14 are, as mentioned, tubular and of similar cross sectional configuration although the outer, lower pole piece 12 is slightly larger in dimensions than the dimensions of the inner, upper pole piece 14. In this manner, the inner, upper pole piece 14 can slide within and telescope with respect to the outer, lower pole piece 12. The two pole pieces, inner, upper 14 and outer, lower 12, are preferable made in about 6 foot lengths, so that together they can accommodate floor to ceiling spans of a minimum of a little more than 6 feet and a maximum of about 12 feet. In most situations, however, the tension pole device will span a normal room height of 8' so that the outer, lower pole piece 12 is fully visible with the inner, upper pole piece 14 exposed to about 2 feet of its length with its balance of about 4 feet contained within the outer, lower pole piece 12. The double thickness, for about 4 feet adds to the structural strength of the device and, of course, enables the device to be capable for use in a range of floor-to-ceiling heights.

The outer, lower pole piece 12 has at least one longitudinal dovetail channel 13 running along its length. The inner, upper pole piece 14 has at least one longitudinal dovetail channel 38 running along its length. The dovetail channel of the inner, upper pole piece is necessary for the locking mechanism. A dovetail channel may be provided to each side of both pole pieces for a variety of other support usages. The pole pieces, 12 and 14, slide with respect to one another. At the top of the outer, lower pole piece 12 is an oval shaped aperture 99 superimposed over the dovetail channel of the inner, upper pole piece 14. A carriage bolt 20 passes through the aperture of the handle, through a cam, through the cam receiver 16 and is secured into a dovetail nut received within the dovetail channel of the inner, upper pole piece 14.

As mentioned, rubber feet 56 and 58 are secured to the aluminum tube extrusions. Rubber foot 56 is intended to contact the floor while rubber foot 58 of the inner, upper pole piece 14 is intended to contact the ceiling. The use of rubber is intended to facilitate the tension mounting of the device between floor and ceiling and is also believed to facilitate installing and then removing the device without marring or damaging the floor or ceiling. The rubber feet 56 and 58 are made from a stiff yet somewhat resilient rubber material such that they will frictionally engage with the floor and ceiling and, yet, to a degree, the feet may be required to absorb all of the extra ½" of pole piece extension as a consequence of turning the locking handle. Frictional engagement of the rubber feet between floor and ceiling provides the force for maintaining the pole in position.

To easily understand the form and function of the individual mechanical components and their interrelationship, it is believed that a brief description of the manner of use of the present invention will prove helpful. In operation, when and where it is determined that a tension pole is to be erected, whether for support of a lamp, a horizontal rod for displaying clothing (between two adjacent poles) or for supporting shelves, for example, the rubber foot 56 is placed on the spot of the floor where the pole is to be located. The inner, upper pole piece 14 is then manually slid upwardly until its rubber foot 58 contacts and provides some frictional resistance to movement of the pole if the user "lets go" of the pole. Clearly, the rubber foot 56 of the inner, upper pole piece should be directly above the rubber foot 58 of the outer, lower pole piece. Then, with the pole 10 in its basically, ultimately desired final position, the handle 24 is rotated 180 degrees, from an upwardly or ceiling-pointing direction (indicative of "unlocked") to a downwardly or floor-pointing direction (indicative of "locked"). The handle can be turned either clockwise or counterclockwise. Rotation of the handle mechanically locks the relative extension of the inner, upper pole piece 14 to the outer, lower pole piece 12 by compressing the two pole pieces toward one another i.e., between a nut, held in the dovetail channel of the inner, upper pole piece 14 and a plug insert housed in the handle. Frictional forces hold the outer, upper pole piece 14 to the inner, lower pole piece 12. The dovetail nut pulls the inner, upper pole piece toward the outer, lower pole piece since turning of the handle causes the carriage bolt (secured to the dovetail nut) to move by the camming action of the plug over a ramp insert within the handle.

In addition, the locking mechanism causes a ½ inch further extension of the outer, upper pole piece 14 with respect to the inner, lower pole piece 12 such that the rubber feet 56 and 58 are each at least slightly more compressed (together they will, if necessary, absorb all of the ½ inch extension). In this manner, the tension pole is locked between the floor and the ceiling and the pole pieces are locked together to the desired height.

Figure 4:
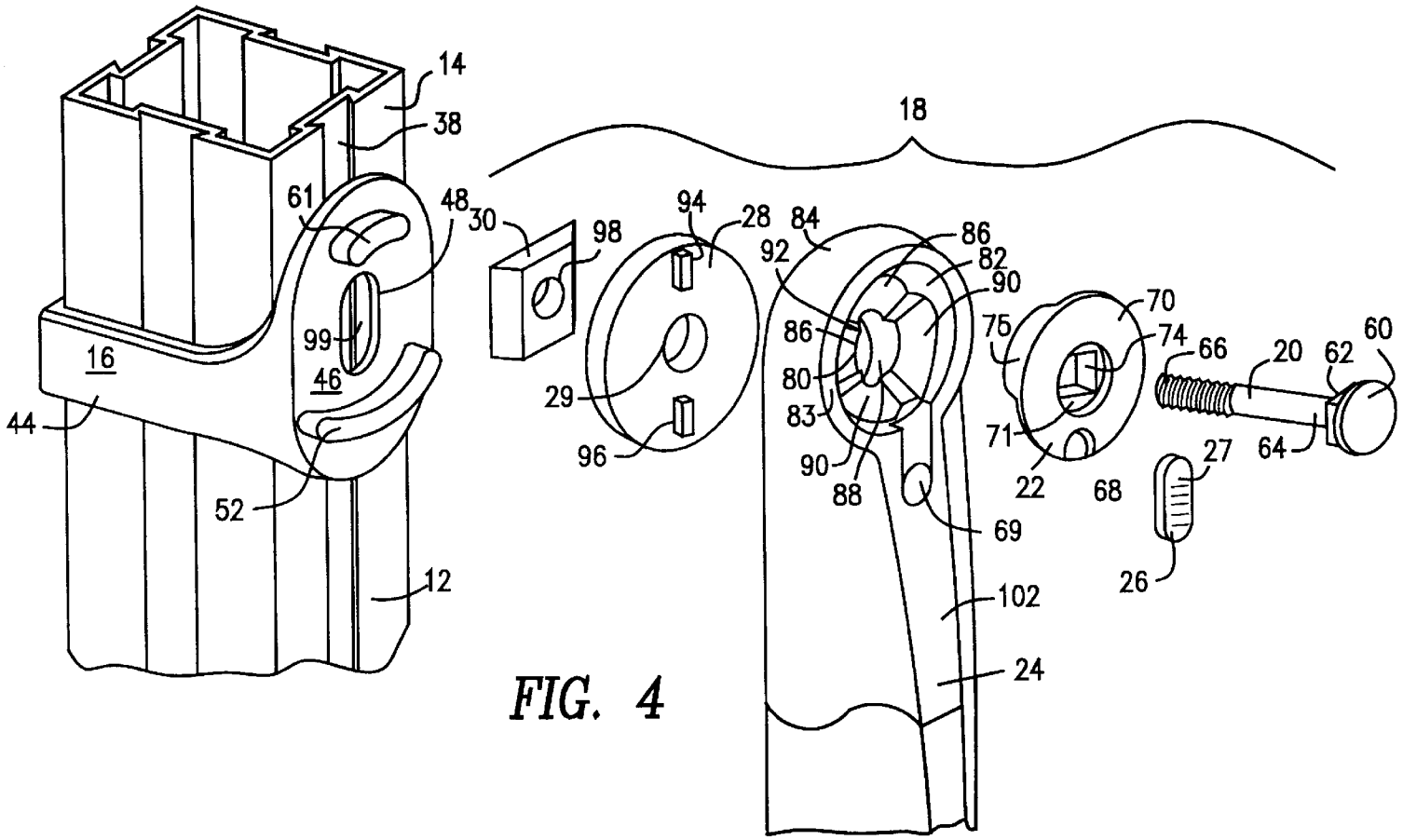
FIG. 4 is a perspective, exploded partial view of the present invention, similar to FIG. 1 and shows a tension pole device with locking mechanism constructed according to the preferred embodiment of the present invention.

Referring now to FIG. 4, it shows the components of the locking mechanism 18. As discussed above, the mechanical interengagement of the components is such that when the handle is turned from the unlocked to the locked position, the outer, upper pole piece 14 extends approximately ½ inch and the two pole pieces are gripped between the head of the carriage bolt, moved outwardly by the plug riding over the insert ramp of the handle and the dovetail nut, located in the dovetail channel of the inner, upper pole piece 14.

The locking mechanism 18 comprises a cam receiver 16, a sliding dovetail nut 30, a carriage bolt 20 (which mates with the nut 30), a cam (preferably Delrin) 28, which fits within a formed recess in the rear of the handle, a handle 24, a ramp insert in the handle having a pair of opposed ramps 86 and 90, and a plastic (also preferably Delrin) plug 22.

The carriage bolt 20 comprises a thin disc head 60, a square nut 62 located just below the disc head 60, a smooth cylindrical, shank surface 64 and a threaded portion 66. The screw threads of threaded portion 66 mate and correspond to the internal screw threads 98 of the sliding dovetail nut 30.

The plug 22 comprises an outside annular surface 70 (provided with a semi-oval recess 68 located at the outer periphery of annular surface 70), a round recess 71 of a depth to accommodate the thickness of disc head 60 of the carriage bolt 20 and a square shaped aperture 74 for receiving the square nut 62 of the carriage bolt 20. With the disc head 60 of the carriage bolt 20 located within the recess 71 and square nut 62 within the aperture 74 of the plug 22 (the smooth shank surface 64 and the screw threads of threaded portion 66 of the carriage bolt 20 passing through the plug 22) it should be apparent that the carriage bolt 20 and the plug 22 move in unison, both rotational about the axis defined by the carriage bolt and inwardly/outwardly along a horizontal axis with respect to the pole pieces.

Figure 4A:
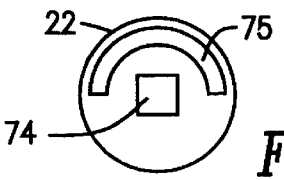
FIG. 4A is a rear view of the plug of FIG. 4.

As shown in FIGS. 4 and 4A, the rear surface of the plug 22 is provided with a semi-annular elevated protrusion or land surface 75. The elevated land surface 75 extends from the rear surface of the plug 22 and mates and corresponds in height, circumferential width and angular extension to the ramps located on the ramp insert of the handle (discussed hereafter but best seen in FIG. 4).

Referring to FIGS. 1, 2, 3 and 4, the handle 24 has a longitudinally extending, hand gripping member 102, centrally located, and a roundish head section 84. The head 84 is formed with a round recess 82 defining a rim 83. The base of the recess 82 defines a retaining wall for a preferably plastic ramp insert. Of course, the ramp insert can be integrally molded with the handle and need not be a separate piece. Ramp insert 88 is secured inside recess 82 held in place by rim 83 and the retaining wall. Ramp insert 88 has a central aperture 92, corresponding in location and size to small aperture 80 of the handle 24. Ramp insert 88 comprises two pairs of semi-annularly extending, opposed high and low ramp surfaces 86 and 90, respectively. By high, it is intended to be understood that the planar surface of that portion of the ramp extends further above (to the right in FIG. 4) the retaining wall of the handle which holds the ramp insert than the planar surface of the low ramp surfaces. Similarly, the planar surfaces of the low ramp surfaces 86 extend less of a distance above the retaining wall 82 of the handle than the planar surfaces of the high ramp surfaces 90. It is important to note that the orientation of the high ramp surfaces 90 need not be at the top or bottom of recess 82 around aperture 80; rather, high ramp surfaces 90 can subtend any 180° arc around aperture 80, as long as plug 22 is properly oriented, as will be explained below.

As mentioned, the outside of the head portion of the handle 24 and the inside of the round recess 82 define a rim 83. It should be apparent to those of skill in the art, when reviewing the figures, that when the device is assembled the disc head 60 of the carriage bolt 20 and the annular surface 70 of plug 22 are coplanar with the top of rim 83 of the handle.

The handle is provided with gripping member 102, running along the length of the handle. The gripping member extends outwardly from a flat surface 105 (see FIG. 3) and provides a convenient surface to facilitate turning of the handle clockwise or counterclockwise about the axis of the aperture 80 and carriage bolt 20. As can be seen in FIG. 1, the rear of the head portion 84 of the handle is provided with a cam member 28. As can also be seen from FIGS. 1 and 3, the rear of the flat surface 105 is substantially coplanar with the rear surface of cam member 28. This is accomplished by an offset incline surface 108 (see FIG. 3) which physically connects gripping member 102 to the head 84 so as to accommodate the ledge of the cam receiver.

The rim 83 of the handle 24 is interrupted by a semi-oval recess 69. A spring-biased safety member 26, oval in shape, sits within the oval shape formed by semi-oval recess 69 and semi-oval recess 68 of the plug 22. The spring 25 biases the safety member 26 towards the semi-oval recess 68 of the plug 22 so that the handle cannot be turned with respect to the plug and carriage bolt unless the user actively moves the safety member 26 (against the spring bias) so that it becomes fully recessed into the semi-oval recess 69 of the handle. It should be understood that the length of major axis of the semi-oval recess of the handle is sufficiently long that the safety member 26 can fully recess into the recess 69 of the handle when pushed there against the force of the spring. In its normal position, because of the spring bias, the safety member 26 has its ends extending into both semi-oval recess 69 of the handle and semi-oval recess 68 of plug 22. The spring loaded safety 26 has ridges 27. The ridges 27 allow the user to easily grasp the spring loaded safety to move it, as desired. The spring loaded safety 26 is situated within the semi-oval aperture 68 of the plug when the safety is in its normally-biased or the locked position.

The rear of handle 24 has an elliptically-shaped cam 28 secured thereto. In the embodiment shown in FIG. 1, the connection between cam 28 and handle 24 is made via a holding screw 110. In an alternate version of the invention, the cam 28 can be located in an elliptically formed recess in the rear of the handle. Alternatively, the cam and handle can be integrally molded or formed. In any event, it should be understood that rotation of handle 24 causes rotation of the cam 28. The cam and handle rotate as a unit.

Referring to FIG. 4, the elliptical cam 28 has an off-center or eccentric aperture 29, and a pair of slots 94 and 96 which pass through the cam. The slots facilitate the placement of the cam within the rear recess of the handle and, indeed, the rear recess of the handle can be provided with mating protuberances (not shown) for the slots to complete the interengagement. The cam 28 is seated against and secured to handle 24 by screw 110 (see FIG. 1) which passes into the rear of the head of the handle. The eccentricity of aperture 29 is about ½ inch along the major axis of cam 28.

A dovetail shaped nut 30, preferably made from steel, has a central aperture with internal screw threads 98 which, as mentioned, mate with the external screw threads 66 of the carriage bolt 20. The dovetail nut 30 is seated yet slides within a matingly dimensioned dovetail channel 38 of the inner, upper pole piece 14. The dovetail channel 38 preferably runs the entire length of the inner, upper pole piece 14. As can be seen from a review of FIGS. 1, 4 and 5, the dovetail nut 30 is retained and slides within the dovetail channel 38 of the inner, upper pole piece 14. While FIG. 4 seems to show dovetail nut 30 in front of the cam receiver 16, FIG. 1 shows that the nut is, when assembled, behind the cam receiver 16 and within the dovetail channel 38 of the inner, upper pole piece 14.

Figure 3:
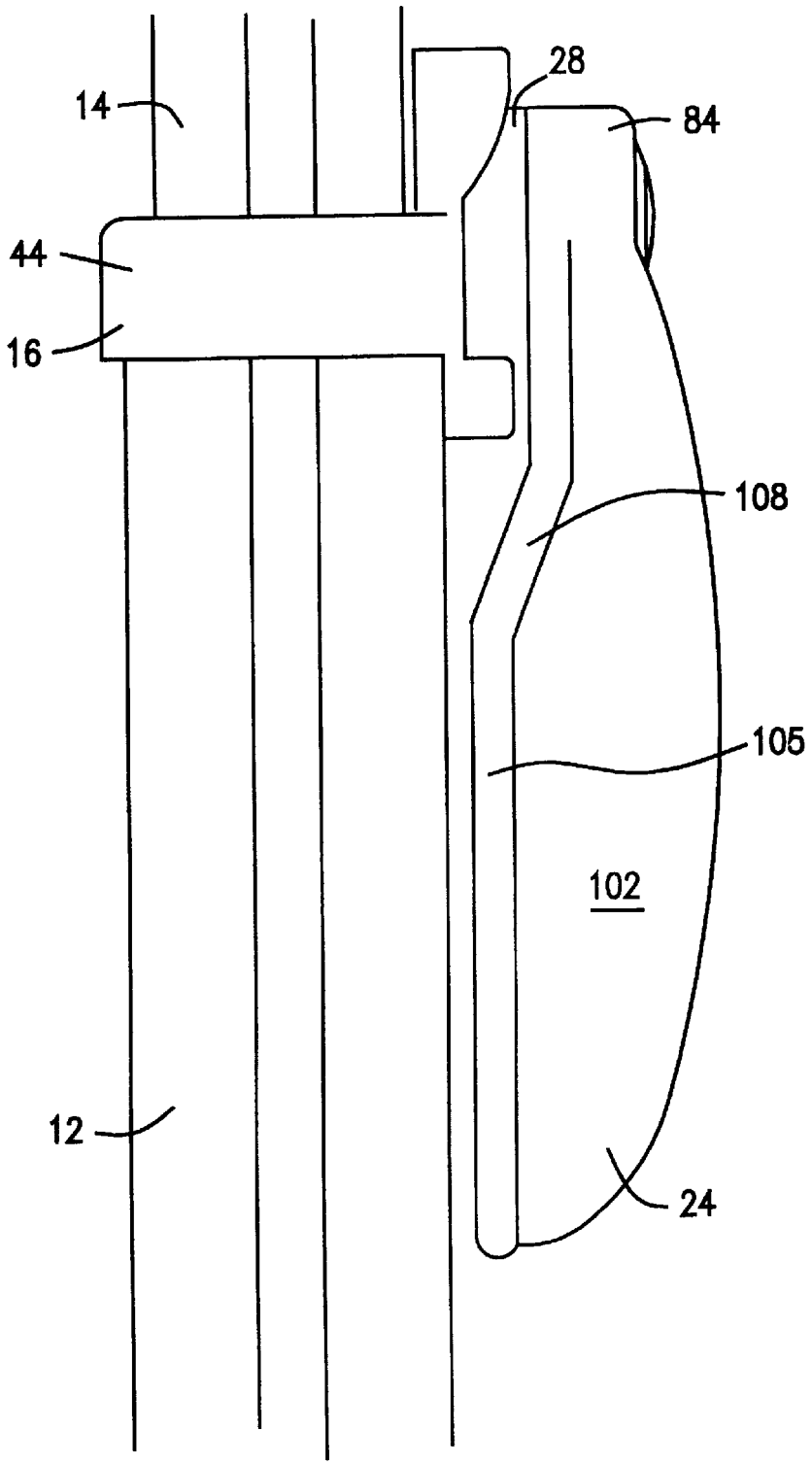
FIG. 3 is a side plan view of FIGS. 1 and 2 and shows the invention.
Figure 7:
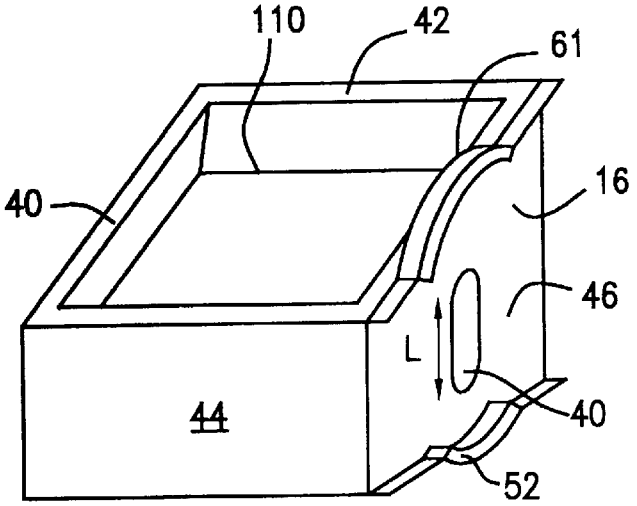
FIG. 7 is a perspective view of the cam receiver, a component of the locking mechanism, which component fits on top of the upper edge of the outer, lower pole piece.

Referring now to FIGS. 3, 4, and 7, the cam receiver 16 is a basic hollow square in cross-section and comprises a pair of opposed sides 42 and 44, which are attached to a rear wall 40 and to a front wall 46. Together the sides, rear and front walls form an open box-like shape which fits over the end of the outer, lower pole piece 12. Preferably, the cam receiver is cast aluminum. The side walls 42 and 44 along with front and rear walls 40 and 46 fit over the side walls of the outer, lower pole piece 12. The inside of the walls 40, 42, 44 and 46 are preferably provided with an internally directed lip 110 for limiting the distance that the cam receiver 16 can slide down over the end of the outer, lower pole piece 12. The front wall 46 of the cam receiver 16 has an oval-shaped aperture 48 through which the smooth cylindrical shank portion 64 of carriage bolt 20 passes. The long dimension of the oval aperture 48, as shown by arrow L in FIG. 7, is no less than about ½ inch. The upper portion of the front wall 40 is provided with an overhang 61 or upper cam travel limiting means while the lower portion of the front wall 40 is provided with a ledge 52 or lower cam travel limiting means. Preferably, the overhang 61 and ledge 52 are integrally molded along with the cam receiver mechanism. The overhang and ledge are sufficiently wide to accommodate the thickness of the cam so that the cam rides on the surface of the overhang and ledge, as the handle is turned. The distance between the upper edge of the ledge 52 and the lower edge of the overhang 61 accommodates the rotation of the cam about its aperture. The cam is secured to the rear of the handle such that the larger distance from the center of the aperture of the cam to its edge extends in the direction of the central gripping member 102.

The carriage bolt 20 passes sequentially through aperture 74 of the plug, aperture 92 of the ramp insert 88, aperture 80 of the handle 24, aperture 29 of the cam 28, aperture 48 of cam receiver 16, aperture 99 of outer, lower pole piece 12 and then secured in threaded aperture 98 of the dovetail nut 30 which sits in channel 38 of inner upper pole piece 14.

Figure 5:
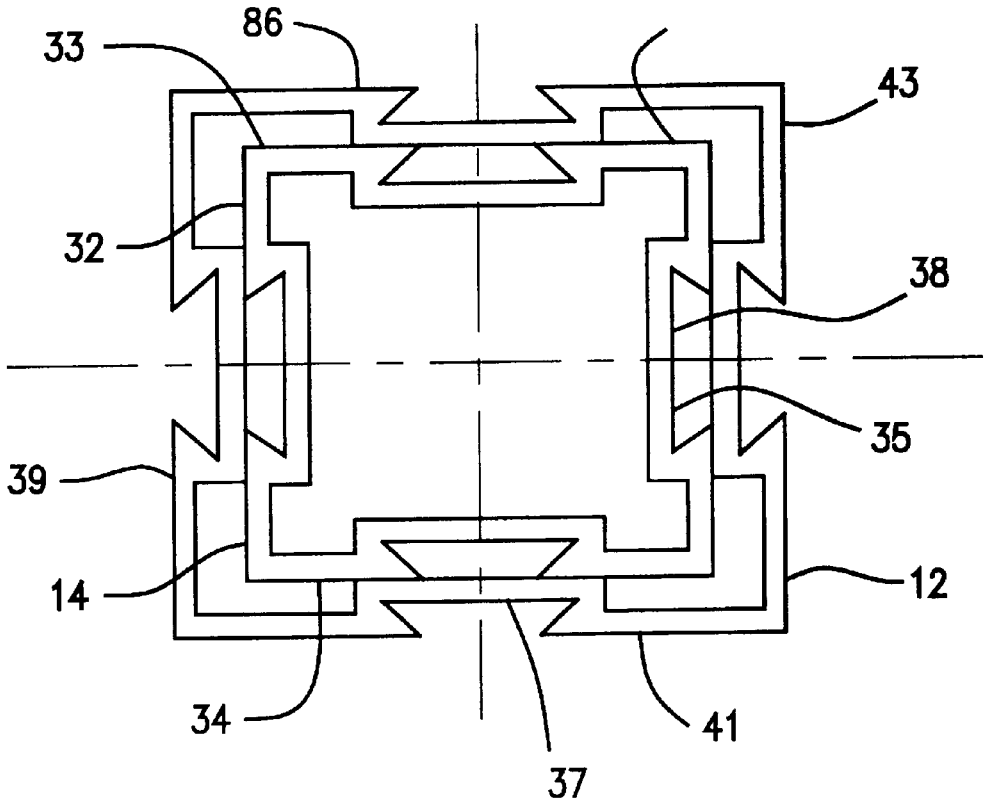
FIG. 5 is a cross-sectional view of the telescopic pole pieces, i.e., the inner, upper pole piece and the outer, lower pole piece.
Figure 6:
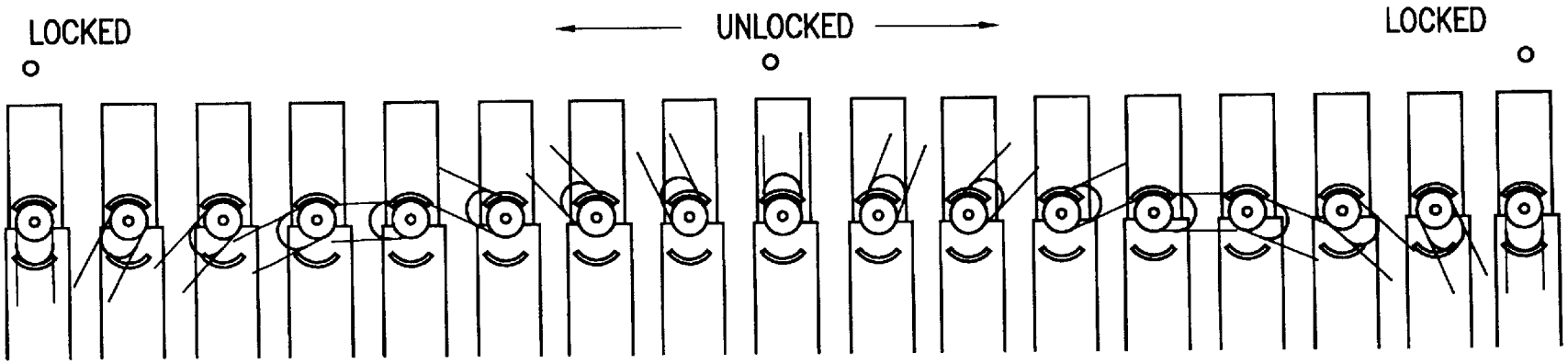
FIG. 6 is a sequential, front partial plan view of the invention, showing the position of the handle and locking mechanism as it would appear when turned from unlocked to locked position, either when the handle is turned clockwise or counterclockwise from the unlocked position (at the center of the figure) to the locked positions shown at the extremities of the drawing.

Referring to FIG. 5, the inner, upper pole piece 14 is shown telescoped inside the outer, lower pole piece 12. The pole pieces are basic rectangular hollow tubes, whose sides are provided with dovetail channels. The inner, upper pole 14 is extruded aluminum and has opposed sides 33 and 34, front side 35 and rear side 32. Each of the sides 32, 33, 34 and 35 of inner, upper pole 14 is preferably provided with a dovetail channel 38. The extra dovetail channels can be used for support devices to be secured to the tension pole. The present invention, however, relating only to the tension pole and its manner of locking needs only a single dovetail channel in the inner, upper pole piece 14. The lower, outer pole 12 is also extruded aluminum and has opposed sides 36, and 41, front side 43 and rear side 39. Each of the sides 36, 39, 41 and 43 of outer, lower pole piece 12 has a dovetail channel 37 running along the length of the pole piece. These, too, can be used for other functions. The outer, lower pole piece 12 has an oval aperture 99 corresponding in location and size to the oval aperture 48 of the cam receiver. The carriage bolt 20 passes through the oval aperture of the outer, lower pole piece.

Figure 9:
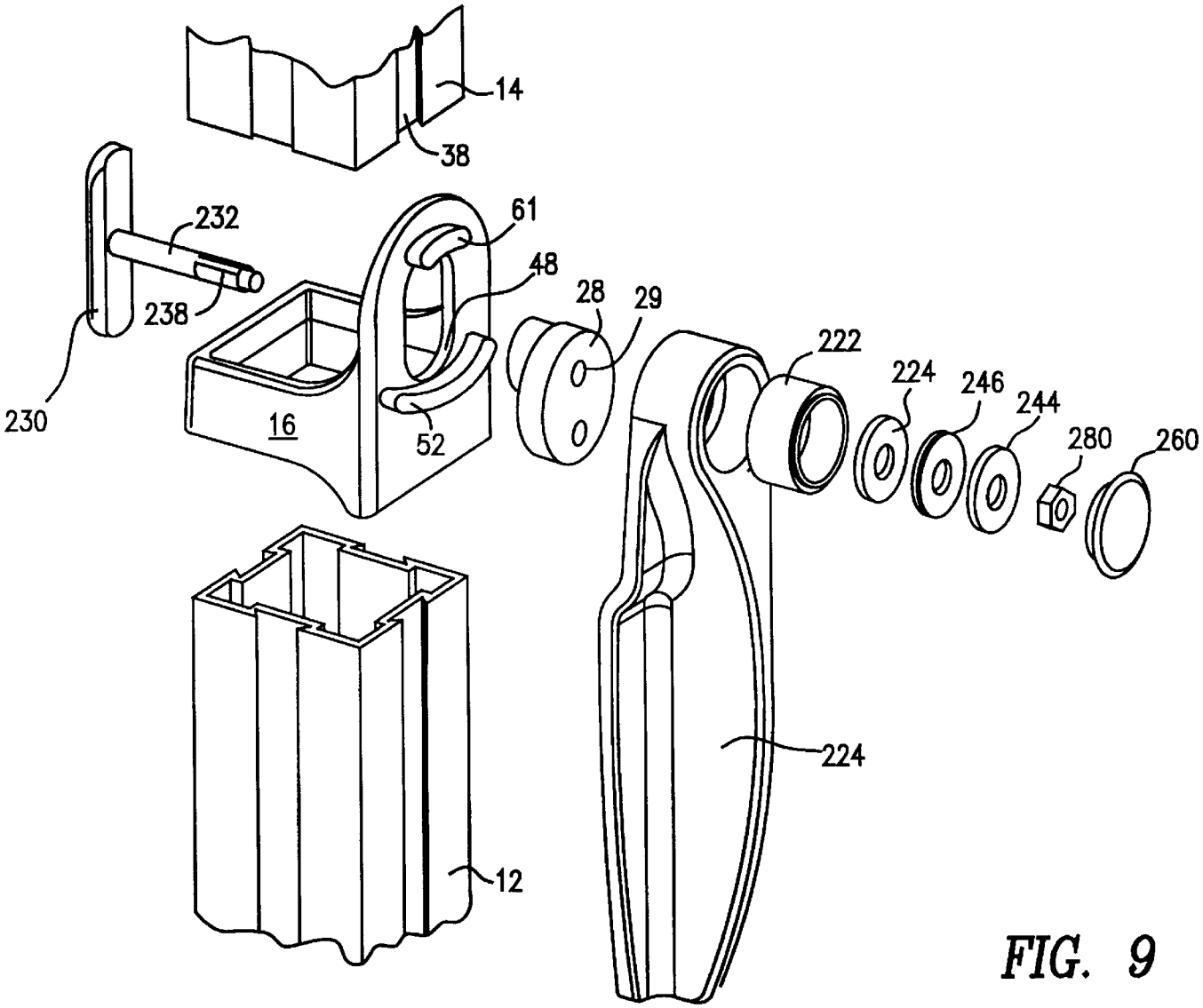
FIG. 9 is an exploded perspective view of a preferred embodiment of the present invention.

The above description of FIGS. 1–8 relates to one embodiment of the invention. The preferred embodiment is shown in FIGS. 9–11 and is described hereinbelow.

The preferred embodiment is similar to the above-described embodiment, in that, in both embodiments, the turning of the handle 180° serves to pull or pinch the inner pole to the outer pole and to simultaneously extend the inner pole upwards. However, instead of providing a bolt 20 secured into dovetail nut 30, as in the embodiment shown in FIG. 4, in the preferred embodiment (see FIG. 9), a unitary dovetail post 230 having a spindle 232 is provided. Dovetail post 230 is inserted into channel 38 in inner upper pole piece 14. Projecting substantially orthogonally from post 230 is spindle 232. Spindle 232 fits through aperture 48 in cam receiver 16, aperture 29 in cam 28, aperture 280 in handle 224 (see FIGS. 10A–B), square aperture 274 of plug 222, and friction grip mechanism 240. The distal end 238 of spindle 232 is squared off so and mates with square aperture 274 in plug 222 (see FIGS. 10A–B). Rotation of handle 224 does not rotate plug 222; that is, when handle 224 is turned, plug 222 remains fixed. Friction grip mechanism 240 includes two standard washers 244 on either side of a belleville washer 246. The assembly terminates with nut 250 and end cap 260, both of which are secured to the threaded tip end of spindle 232.

Figures 10A, 10B:
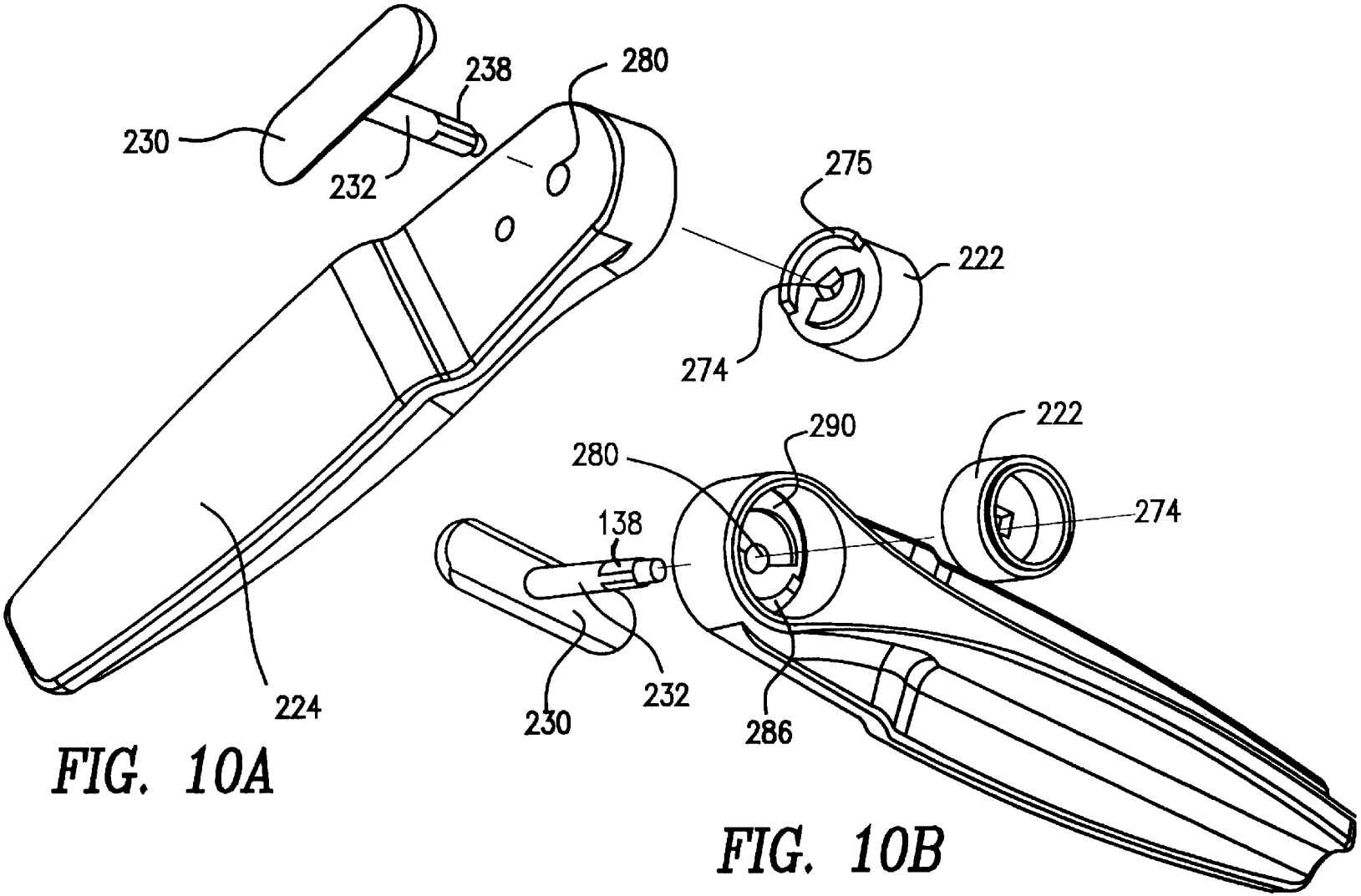
FIGS. 10A–B are front and rear perspective views of the handle mechanism, dovetail post and plug of the preferred embodiment of the present invention.
Figure 11:
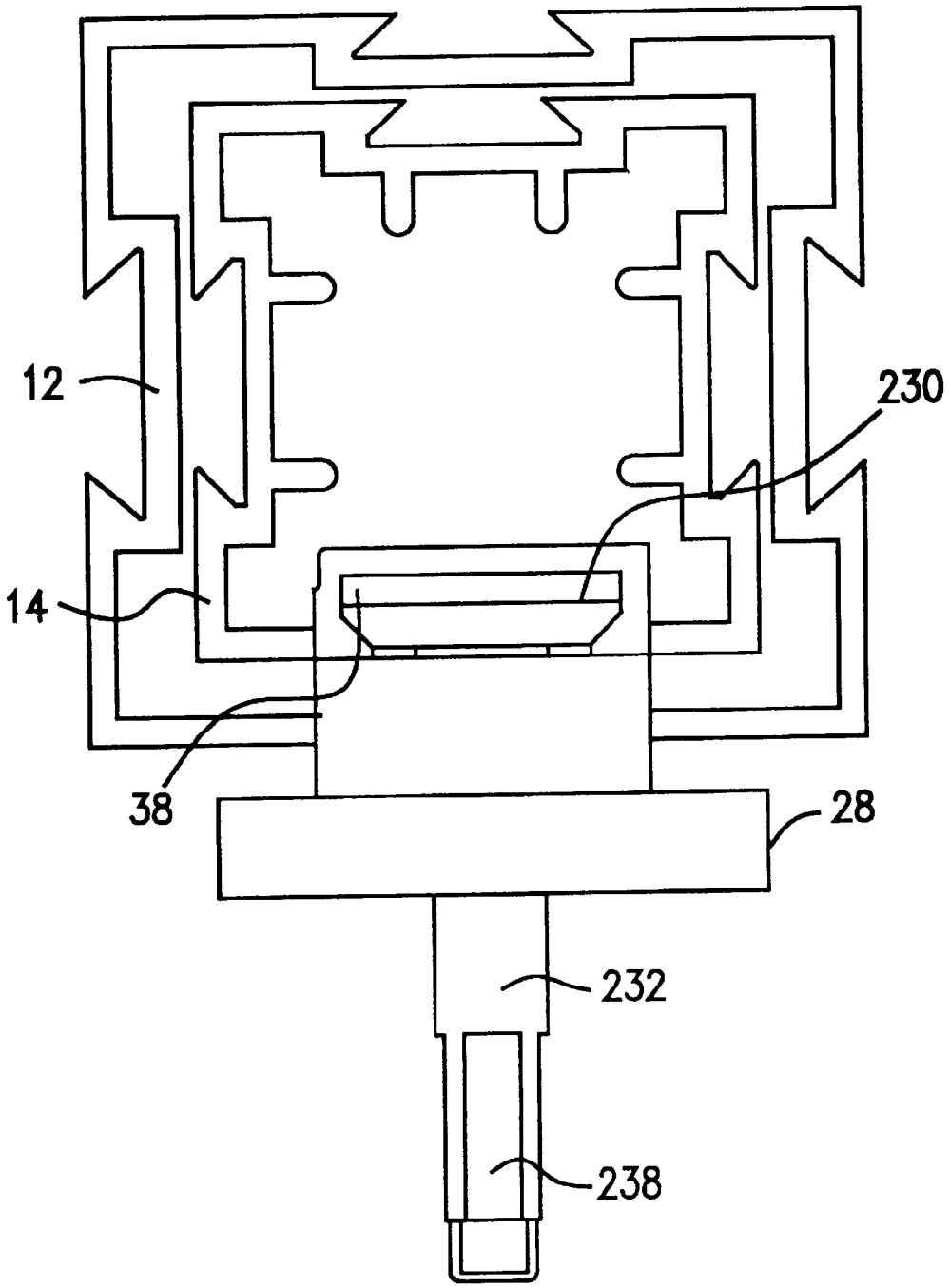
FIG. 11 is a cross-sectional view of the telescopic pole pieces, i.e., the inner, upper pole piece and the outer, lower pole piece in the preferred embodiment of the present invention.

As shown in FIGS. 10A–B, plug 222 of the preferred embodiment is similar to plug 22 of the other described embodiment. Plug 222 is provided on its rear with a semi-annular protuberance or land surface 275. Land surface 275 cooperates and slides over raised ramp portion 290 of a ramp insert, on the inside of handle 224. This forces the inner pole to be pinched and moved toward the outer pole (i.e., to the right in FIG. 9). When handle 224 is in the unlocked position, land surface 275 of plug 222 is aligned with the recessed portion 286 of handle 224. When the handle 224 is rotated into the locked position, the handle rotates relative to the held plug 222 (the square aperture 274 of the plug 222 fixes it from rotation since the aperture snugly fits over the squared off distal end 238 of the spindle 232.) When the handle moves to the locked position, the recessed portion 286 and land surface 275 are no longer aligned; rather, in the locked position, raised ramp portion 290 and projected land surface 275 are aligned. This forces plug 222 away from handle 224 (to the right); however, because plug 222 is fixedly attached to spindle 232 of dovetail post 230 (which is fixedly secured in dovetail channel 38) upper inner pole piece 14 is pulled in the same direction that plug 222 is being forced, i.e., to the right and towards lower outer pole piece 12.

In a preferred embodiment of the invention both the inner and outer poles are each six feet in length. However, the length of the inner and outer poles may vary, as required by the overall height of the tension pole to be erected and the height of the ceiling above the floor at a particular location. In a preferred embodiment of the invention, the handle and cam receiver are made of cast aluminum; the plug and cam are each made of plastic, such as Delrin® and the dovetail nut and carriage bolt are made of steel. The pole pieces are extruded aluminum.

Both the preferred and alternate embodiments of the invention operate as follows, with description mainly being given with respect to the alternate embodiment. It is to be understood that the preferred embodiment functions in substantially the same way; nevertheless, references are made to elements in the preferred embodiment in parentheses, when appropriate. The inner, upper pole piece 14 and the outer, lower pole piece 12 are situated between a floor and a ceiling and when locked in place and secured provide a means for supporting other objects. The inner pole is telescopic within the outer pole. The rubber foot 58 of the outer, lower pole piece 12 is located on the floor at the spot where the pole is desirably erected. Then the user manually extends the inner, outer pole piece 14 until its rubber foot 56 firmly contacts the ceiling. The user performs the telescoping function while trying to ensure that the rubber foot of the inner, upper pole piece 14 is directly above the outer, lower pole piece 12. The telescoping of the inner, upper pole piece 14 within the outer, lower pole piece 12 occurs until the rubber feet are contacting both floor and ceiling. In this position, the handle 24 is pointing upwardly, for example, in the unlocked position (as shown in the center drawing of FIG. 6). Then, the user turns the handle, clockwise or counterclockwise, 180 degrees. This causes the cam to ride on the ledge of the cam receiver and thus the inner, upper pole piece 14 moves upwardly, relative to the outer, lower pole piece 12, up to ½ inch. The rubber feet of the tension pole 10 can absorb up to a total of the ½ inch further extension of the pole pieces so that if the pole pieces were otherwise to damage the ceiling by the extension, the rubber feet would "give" or absorb the resistance provided by the floor and/or ceiling before damaging the floor or ceiling. The initial manual extension of the pole pieces followed by the ½ inch further extension ensures holding of the tension pole in position. A tight fit of the tension pole between floor and ceiling is ensured.

The cranking of the handle to the locked position performs two mechanical operations, simultaneously. First, as mentioned, the turning of the handle, with the attached cam 28, causes the inner, upper pole 14 to raise ½ inch so that the pole is firmly secured between ceiling and floor. The cam rotates eccentrically, rides on the ledge 52 and thus raises the carriage bolt and the inner, upper pole piece 14. Second, but at the same time, the rotation of the handle causes the plug 22 (or plug 222) and its elevated lands to ride over the elevated ramps 90 (or 290) of the ramp insert 88 (or of handle 224). This causes compressive forces to be transmitted between the dovetail nut 30 (or dovetail post 230), on the inside of the dovetail channel 38 of the inner, upper pole piece 14, and the outer, lower pole piece 12, pinched toward the inner pole piece by the mechanical action of the bolt 20 (or spindle 232), acting on the plug 22 (or 222), through the mechanical action of the handle. The handle may be turned clockwise or counterclockwise to reach the downwardly-directed or "locked" position. The handle is turned counterclockwise or clockwise to the upwardly directed "unlocked" position to unlock the inner, upper pole piece 14 from the outer, lower pole piece 12. This rotation allows the elevated land of the plug to slip into the recessed ramps of the ramp insert. That removes the compressive force between the mechanical elements and also allows the pole pieces to slide together, i.e., to retract in length by telescoping the inner, upper pole piece 14 sliding and telescoping within the outer, lower pole piece 12. The spring loaded safety 26 is biased in position in the semi-oval aperture 68 of the plug 22 to keep the inner pole in the locked or extended position to the outer pole and to prevent movement of the handle except when the user moves the safety member. When the user presses downward on the ridges 27 of the safety, the pressure causes the spring to retract and the safety shifts from its position in the semi-oval recess 68 of the plug 22 into the semi-oval recess 69 of the handle 24.

The manner that the locking mechanism operates is basically as follows: When the handle is turned, the cam turns. However, the plug, secured to the carriage bolt by the mating of the square aperture 74 to the square nut 62 does not turn since the screw threads 66 of the carriage bolt 20 are secured to the screw threads 98 of the dovetail nut 30. Since the dovetail nut is maintained in the dovetail channel 38 of the inner, upper member and is prevented from rotation therein, the rotation of the handle, with respect to the stationary plug, causes the ramp insert of the handle to force the plug 22 away from the handle.

This provides the compressive force for securing the pole pieces together. Also, the rotation of the cam about the carriage bolt elevates and lowers the inner, upper pole piece with respect to the outer, lower pole piece by the riding of the cam on ledge 52 and overhang 61 which causes movement of the bolt 20 with respect to the cam receiver 16 about the axis defined by the carriage bolt. This causes the inner, upper pole piece to move.

The use of the above-described dovetail channel system, be it in the preferred embodiment or the alternate embodiment, has at least one other significant advantage over conventional tension poles: it possesses a smaller and less obtrusive profile. Conventional tension poles have a clamping device that encircles the entire pole, thus adding to the overall profile of the device. By contrast, the dovetail post 230 or dovetail nut 30 sit internal to the outermost surface of the inner pole piece, thus providing a smaller and less obtrusive profile.

The invention is not limited to the above description. For example, the above description discusses a single dovetail channel on one of the upper or lower pole pieces. However, as shown in the figures, multiple channels may be provided. For example, as shown in FIGS. 5 and 11, a dovetail channel is provided in each side of both upper pole piece 14 and lower pole piece 12. Providing such multiple dovetail channels makes the tension pole more advantageous and easier to use.

Also, the above description discusses square pole pieces. However, the invention is not so limited and covers any geometric configuration. For example, the cross section of the pole pieces may be triangular, hexagonal, octagonal, or in the shape of any polygon. The tension pole may also be circular, so long as a dovetail channel is provided therein. The cross-section of the tension pole may also be any convenient irregular shape.

The above specification and the detailed description of the preferred embodiment are to be considered as representative, only, as the scope of the invention to which we are entitled, is intended to be covered by the scope of the claims, as interpreted by the Courts, and their reasonable and legal equivalents, as also interpreted by the Court and the applicable statutes.

We claim:

1. A tension pole comprising:

(a) a lower pole piece;

(b) an upper pole piece, said upper pole piece being manually and mechanically telescopable with respect to said lower pole piece; and (c) a locking mechanism comprising a handle and camming means for simultaneously mechanically telescoping said upper pole piece with respect to said lower pole piece and for pinching said lower pole piece to said upper pole piece, wherein said camming means comprises a cam receiver secured to either said upper or lower pole piece and said handle having a cam surface rotatable therewith, said cam receiver having a camming ledge on which said cam rides for mechanically telescoping said upper tension pole piece with respect to said lower tension pole piece.

2. A tension pole as claimed in claim 1 wherein said upper pole piece and said lower pole piece comprise rubber feet which are capable of absorbing the mechanical telescoping of said tension pole.

3. A tension pole as claimed in claim 1 wherein said lower tension pole piece is slidable over said upper tension pole piece.

4. A tension pole as claimed in claim 1, wherein at least one of said upper and lower pole pieces further comprises a dovetail channel.

5. A tension pole as claimed in claim 4, said locking mechanism further comprising:

a securing post fixedly secured in said dovetail channel, having a spindle formed therewith;

a cinching plug, fixedly and nonrotatably attached to said spindle and disposed in a recess in said handle; and cinching means for forcing said cinching plug away from said tension pole when said handle is rotated from an unlocked position to a locked position.

6. A tension pole as claimed in claim 5, wherein said cinching means comprises at least one elevated ramp secured to said handle and an elevated land secured to said cinching plug.

7. A tension pole as claimed in claim 6, wherein said elevated ramp is part of a ramp insert secured within said recess of said handle and said elevated land is formed on said cinching plug, wherein rotation of said handle from said unlocked position to said locked position causes said land of said cinching plug to ride over said ramp of said ramp insert.

8. A tension pole as claimed in claim 4, wherein said upper and lower pole pieces are rectangular in cross-section.

9. A tension pole as claimed in claim 8, wherein said upper and lower pole pieces include a dovetail channel on each side.

10. A tension pole as claimed in claim 1 wherein said cam and said locking mechanism rotate about a single horizontal axis.

11. A tension pole as claimed in claim 1 wherein said cam is eccentric and rotatable along with said handle about an off-center aperture of said cam.

12. A tension pole as claimed in claim 1 further comprising:

a safety means for ensuring that said handle will not accidentally turn unless said safety means is intentionally overridden by a user.

13. A tension pole as claimed in claim 12 wherein said handle is provided with a first safety recess and a plug is rotatably secured to said handle and provided with a second safety recess, and said safety means comprises a movable element which is spring biased into both said first and second safety recesses.

14. A tension pole as claimed in claim 13 wherein said movable element can be manually moved out of engagement with either said first or said second safety recess.

15. A tension pole as claimed in claim 1 wherein said locking mechanism further comprises:

a carriage bolt having a screw thread end and a head end; and a carriage bolt moving means for moving said carriage bolt toward and away from said tension pole along a horizontal axis, upon turning of said handle, wherein said screw thread end of said carriage bolt is secured to a nut which is held in position along said horizontal axis to one of said upper and lower pole pieces, such that rotation of said handle about said horizontal axis causes said carriage bolt and said nut to compress said upper and lower pole pieces therebetween.

16. A tension pole as claimed in claim 15, wherein said nut is dovetailed and either said upper or lower pole piece is provided with a dovetail channel which mates and retains said nut.

17. A tension pole as claimed in claim 15, wherein said carriage bolt moving means comprises at least one elevated ramp secured to said handle and an elevated land secured to said carriage bolt.

18. A tension pole as claimed in claim 17, wherein said elevated ramp is part of a ramp insert secured within said handle and said elevated land is part of a plug, rotatable with respect to said ramp insert and located within said handle such that rotation of said handle causes at least one of said lands of said plug to ride over at least one of said ramps of said ramp insert.

19. A tension pole as claimed in claim 18, wherein said plug is nonrotatably secured to said carriage bolt.

20. A tension pole as claimed in claim 18 wherein said plug is plastic.

21. A tension pole as claimed in claim 1 wherein said handle is located at about 6 feet from one end of either said upper or lower pole piece.

22. A tension pole comprising:

(a) a lower pole piece;

(b) an upper pole piece, said upper pole piece being manually and mechanically telescopable with respect to said lower pole piece; and (c) a locking mechanism comprising a handle and camming means for simultaneously mechanically telescoping said upper pole piece with respect to said lower pole piece and for pinching said lower pole piece to said upper pole piece, wherein said locking mechanism further comprises: a carriage bolt having a screw thread end and a head end; and a carriage bolt moving means for moving said carriage bolt toward and away from said tension pole along a horizontal axis, upon turning of said handle, wherein said screw thread end of said carriage bolt is secured to a nut which is held in position along said horizontal axis to one of said upper and lower pole pieces, such that rotation of said handle about said horizontal axis causes said carriage bolt and said nut to compress said upper and lower pole pieces therebetween.

23. A tension pole as claimed in claim 22, wherein said upper pole piece and said lower pole piece comprise rubber feet which are capable of absorbing the mechanical telescoping of said tension pole.

24. A tension pole as claimed in claim 22, wherein said lower tension pole piece is slidable over said upper tenon pole piece.

25. A tension pole as claimed in claim 22, wherein at least one of said upper and lower pole pieces further comprises a dovetail channel.

26. A tension pole as claimed in claim 22, further comprising:

a safety means for ensuring that said handle will not accidentally turn unless said safety means is intentionally overridden by a user.

27. A tension pole as claimed in claim 22, wherein said nut is dovetailed and either said upper or lower pole piece is provided with a dovetail channel which mates and retains said nut.

28. A tension pole as claimed in claim 22, wherein said carriage bolt moving means comprises at least one elevated ramp secured to said handle and an elevated land secured to said carriage bolt.

29. A tension pole as claimed in claim 28, wherein said elevated ramp is part of a ramp insert secured within said handle and said elevated 1 and is part of a plug, rotatable with respect to said ramp insert and located within said handle such that rotation of said handle causes at least one of said lands of said plug to ride over at least one of said ramps of said ramp insert.

30. A tension pole as claimed in claim 29, wherein said plug is nonrotatably secured to said carriage bolt.

31. A tension pole comprising:

(a) a lower pole piece;

(b) an upper pole piece, said upper pole piece being manually and mechanically telescopable with respect to said lower pole piece, at least one of said upper and lower pole pieces including a dovetail channel; and (c) a locking mechanism comprising a handle and camming means for simultaneously mechanically telescoping said upper pole piece with respect to said lower pole piece and for pinching said lower pole piece to said upper pole piece, said locking mechanism further comprising:

(i) a securing post fixedly secured in said dovetail channel, having a spindle formed therewith;

(ii) a cinching plug, fixedly and nonrotatably attached to said spindle and disposed in a recess in said handle; and (iii) cinching mans for forcing said cinching plug away from said tension pole when said handle is rotated from an unlocked position to a locked position.

32. A tension pole as claimed in claim 31, further comprising:

a safety means for ensuring that said handle will not accidentally turn unless said safety means is intentionally overridden by a user.

33. A tension pole as claimed in claim 31, wherein said cinching means comprises at least one elevated ramp secured to said handle and an elevated land secured to said cinching plug.

34. A tension pole as claimed in claim 33, wherein said elevated ramp is part of a ramp insert secured within said recess of said handle and said elevated land is formed on said cinching plug, wherein rotation of said handle from said unlocked position to said locked position causes said land of said cinching plug to ride over said ramp of said ramp insert.

35. A tension pole comprising:

(a) a lower pole piece;

(b) an upper pole piece, said upper pole piece being manually and mechanically telescopable with respect to said lower pole piece;

(c) a locking mechanism comprising a handle and camming means for simultaneously mechanically telescoping said upper pole piece with respect to said lower pole piece and for pinching said lower pole piece to said upper pole piece; and (d) a safety means for ensuring that said handle will not accidentally turn unless said safety means is intentionally overridden by a user, wherein said handle is provided with a first safety recess and a plug is rotatably secured to said handle and provided with a second safety recess, and said safety means comprises a movable element which is spring biased into both said first and second safety recesses.

36. A tension pole as claimed in claim 35, wherein said movable element can be manually moved out of engagement with either said first or said second safety recess.

* * * * *